United States Patent [19]

Roidt et al.

[11] 3,956,605

[45] May 11, 1976

[54] FLUID BLAST CIRCUIT INTERRUPTER WITH A COMPACT NOZZLE STRUCTURE AND VERSATILE OPERATING MECHANISM

[75] Inventors: Robert M. Roidt; Bruce W. Swanson, both of Pittsburgh, Pa.

[73] Assignee: Westinghouse Electric Corporation, Pittsburgh, Pa.

[22] Filed: May 20, 1974

[21] Appl. No.: 471,737

[52] U.S. Cl. ..... 200/148 B

[51] Int. Cl.[2] ..... H01H 33/42

[58] Field of Search ..... 200/148 R, 148 B

[56] References Cited

UNITED STATES PATENTS

| | | | |
|---|---|---|---|
| 3,659,065 | 4/1972 | Roidt et al. | 200/148 B |
| 3,725,623 | 4/1973 | Fischer et al. | 200/148 B |
| 3,858,015 | 12/1974 | Deno | 200/148 R |

*Primary Examiner*—Robert S. Macon

*Attorney, Agent, or Firm*—R. E. Converse, Jr.

[57] ABSTRACT

A fluid blast circuit interrupter is provided having a pair of compact toroidal-shaped nozzles, steady-state current-carrying contacts, arc-establishing contacts, and a blast valve. A rotatable cam plate provides independent actuation of the steady-state contacts, the arc-establishing contacts, and the blast valve mechanism in a variable and predetermined manner.

10 Claims, 17 Drawing Figures

FLUID BLAST CIRCUIT INTERRUPTER WITH A COMPACT NOZZLE STRUCTURE AND VERSATILE OPERATING MECHANISM

BACKGROUND OF THE INVENTION

1. Field of the Invention

The invention relates generally to electrical apparatus and more particularly to circuit interrupters utilizing a blast of arc-quenching fluid to extinguish an established arc.

2. Description of the Prior Art

As is well known by those skilled in the art, fluid blast circuit interrupters effect the interruption of alternating current circuits by establishing an arc between separating contacts located in the vicinity of a nozzle. This arc provides a high-conductance path between the contacts until the arc is extinguished by a blast of arc-quenching fluid directed against the arc. As the alternating current passes through current-zero, the arc-extinguishing fluid acts to transform the arc channel into an insulating medium. For the interruption to be successful the blast of fluid must transport energy away from the arc channel at a faster rate than the arc is delivering energy into the channel. If this is not the case the phenomenon of energy clogging occurs, delaying or perhaps preventing the successful interruption of the arc. In addition, a high-energy arc contributes to the erosion of contacts and general degradation of performance of the circuit breaker, increasing the need for maintenance. Since arc energy is directly related to arc length, it is desirable to maintain a short low-energy arc during the time preceding the first current zero.

In previous practice, long expanding nozzles were used in order to obtain desirable flow characteristics and adequate mixing of arc-quenching fluid in the nozzle. The requirement of a short low-energy arc in a circuit interrupter using a long nozzle configuration called for an arc drawn transverse to the axis of the nozzle in an area upstream from the nozzle throat. Often steady-state contact fingers, sealing valves, and other mechanisms were present in this area resulting in points of high electric field concentration. In order to assure that an arc would not be reignited following successful interruption at the first current zero and to ensure that the interrupter will pass the requirements of basic impulse level (BIL) testing, this high electric field concentration made it necessary to maintain a post-interruption nozzle separation greater than that required for optimum dynamic operation.

In order to transform the arc channel within the nozzle structure from a high conductance medium into a good insulating medium it is necessary that arc products be rapidly cleared from the chamber by the blast of arc-extinguishing fluid. The degree to which this can be accomplished determines the allowable rate of rise of recovery voltage (RRRV) which the interrupter can withstand. Since the long expanding nozzle structure results in a clearing time greater than would be required for a shorter nozzle, better rate of rise of recovery voltage performance is obtained from the latter.

Good arc control and arc extinguishing characteristics can be obtained if the arc is established and maintained axially with regard to the nozzle. It is known in the art that control of arc length during the interruption process is helpful in obtaining successful interruption. In U.S. Pat. No. 3,659,065 issued to the applicants, this was achieved in a puffer type interrupter by separately controlling fluid blast production and contact separation. It would be desirable to achieve independent control of all mechanisms involved in the interruption process.

In designing circuit interrupters for different ratings and classes of service different operating sequences for valves, nozzles, and contacts may be required. In order to achieve the lowest possible production costs interrupters made for different classes of service should have a high degree of parts commonality. Therefore it would be desirable for a circuit interrupter to achieve axial arc position and to control arc length, fluid blast initiation, contact position, and other operating parameters while providing for versatile interruption mechanism sequences with a minimum of parts changes.

SUMMARY OF THE INVENTION

The present invention is a new and improved fluid blast circuit interrupter having movable steady-state contacts, movable arc-establishing contacts, compact fluid flow directing means, valve means for initiating a blast of arc extinguishing fluid, and a source of high pressure arc extinguishing fluid. The valve means and the arc establishing contacts are individually actuable. Common means for separately actuating the valve means, the steady-state contacts, and the arc-establishing contacts in a variable and predetermined manner are provided. The arc is established through compact toroidal-shaped nozzles and remains axial to the nozzle at all times.

BRIEF DESCRIPTION OF THE DRAWINGS

The invention may be more readily understood when considered in view of the following detailed description of exemplary embodiments thereof, taken with the accompanying drawings in which:

FIGS. 7*a*, 7*b*, 7*c*, and 7*d* are a series of schematic views showing yet another possible interrupting sequence.

DESCRIPTION OF THE PREFERRED EMBODIMENT

Figure 1:
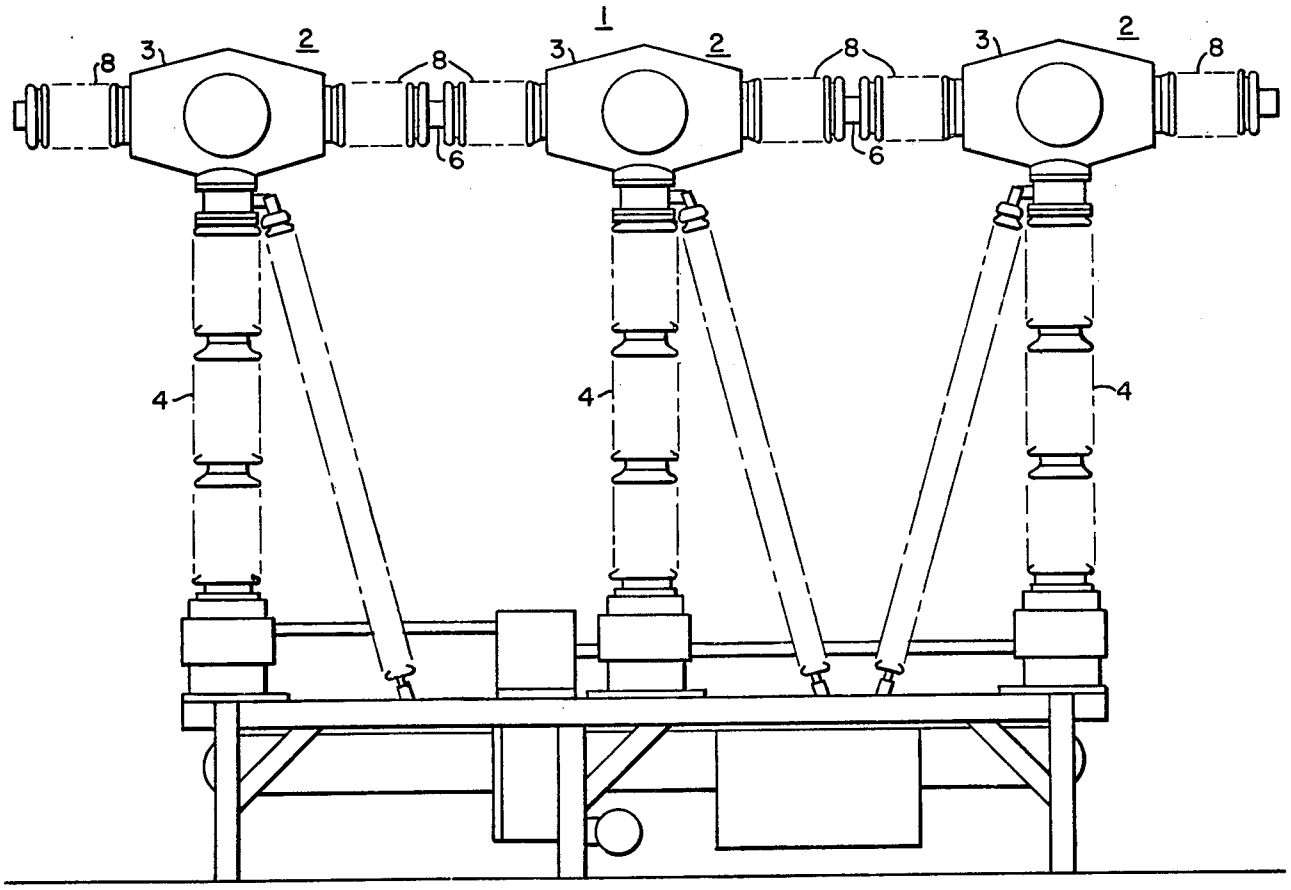
FIG. 1 is a side elevational view of one pole unit of a three-phase high-voltage fluid blast circuit interrupter embodying the principles of the present invention.

Referring to FIG. 1 there is shown one pole unit 1 of a three-phase high-voltage fluid-blast circuit interrupter embodying the principles of the present invention. The other two pole units are identical except for the inter-pole electrical control wiring, gas lines, and air lines and for the house on the middle pole unit which contains the common parts of the air and gas system. Reference may be had to U.S. Pat. No. 3,291,947, issued Dec. 13, 1966 to Roswell C. Van Sickle, assigned to the assignee of the instant application, for a detailed description of the external characteristics of the circuit interrupter.

Three interrupting head units 2 are supported upon insulating columns 4 and are connected by terminal studs 6 extending through terminal bushings 8. Each interrupting head unit 2 includes a metallic housing 3 containing a pair of series-connected arc-extinguishing units, one of which is more particularly illustrated in FIG. 2. A high-pressure plenum 10 is connected to a source 12 of high-pressure arc-extinguishing fluid such as sulfur hexafluoride ($SF_6$) through an inlet 14. A nozzle plate 16 forms one wall of the high-pressure plenum 10 and includes a toroidal-shaped nozzle mouth 18. Opposite the nozzle plate 16 is an apertured plate 20 with a movable nozzle member 22 extending therethrough. The movable nozzle member 22 also includes a toroidal-shaped nozzle mouth 24 which, together with the nozzle mouth 18, forms a double-flow nozzle. The nozzle member 22 slides upon gas-tight seals 26 embedded in the walls of the plate 20.

Figure 2:
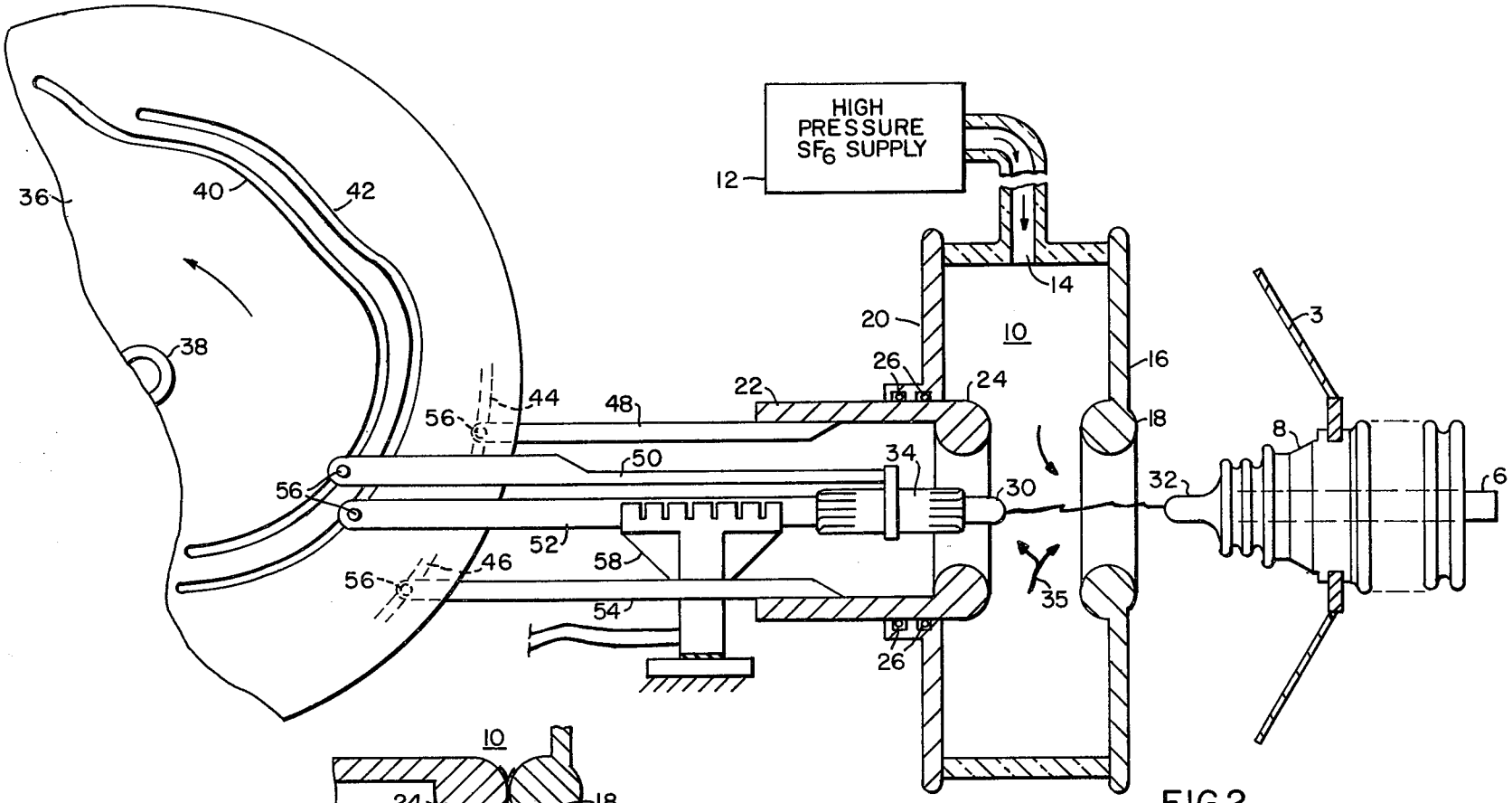
FIG. 2 is a schematic diagram of one of the two arc-extinguishing units enclosed in each of the modular interrupting heads of the pole unit of FIG. 1.
Figure 3:
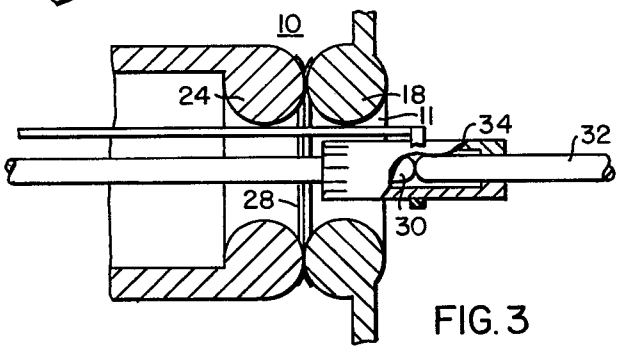
FIG. 3 is an enlarged view of the nozzle and contact structures of the mechanism of FIG. 2, shown in a closed position.

Referring to FIG. 3, there is shown in more detail the nozzle mouths 18 and 24 in a closed circuit position. These nozzle mouths are in abutment, with a thin gasket 28 of dielectric material forming a gas-tight seal preventing the $SF_6$ within the high-pressure plenum 10 from entering an arcing chamber 11 within the abutting nozzle mouths. Extending through the nozzle mouths 18 and 24 and coaxial therewith is a movable arcing contact 30 in abutment with a fixed arcing contact 32, which is one end of the terminal stud 6. The terminal stud 6 extends through the terminal bushing 8, which in turn extends through the wall of the metallic housing 3, as shown in FIG. 2. Although the contacts 30 and 32 are in abutment, the major portion of the current during steady state closed-circuit conditions is carried by a steady-state current-carrying finger sheath 34 coaxially surrounding the arcing contacts 30 and 32. This finger sheath makes sliding engagement with the contacts 30 and 32 when the circuit interrupter is in a closed circuit position. As will be more fully explained the finger sheath 34 is retracted along the contact 30, disengaging the contact 32 just prior to arc initiation.

In FIG. 2 there is shown a cam plate 36, partially cutaway, rotatably driven by an operating shaft 38. The cam plate 36 includes a series of contoured channels 40, 42, 44, 46. These channels may be either cast or machined into the surface of the plate 36. Also illustrated in FIG. 2 is a series of rigid extending members 48, 50, 52, and 54 each terminating in a short pin 56 extending substantially perpendicular to the rigid members. Each pin 56 is engaged in one of the contoured channels 40, 42, 44 or 46. At ends opposite from the extending short pins 56 the rigid members 48 and 54 are attached to the movable nozzle structure 22. Extending members 50 and 52 are similarly attached to the finger sheath 34 and movable arcing contact 30, respectively. A sliding connection 58 engages the extending member 52 connected to the arcing contact 30 and is electrically connected to an identical sliding contact of a similar interrupting mechanism controlled by the left half of the cam plate 36, not shown. The movable nozzle structure 22, the finger sheath 34, and the arcing contact 30 are all movable in a longitudinal direction. In order to operate the circuit interrupter the drive shaft 38 is rotated in a counterclockwise direction by a suitable actuating mechanism such as that disclosed in the aforementioned U.S. Pat. No. 3,291,947.

As the cam plate 36 rotates in a counterclockwise direction the pins 56 engaged by contoured channels 40, 42, 44 and 46 are pulled leftward, producing corresponding leftward motion of the movable nozzle structure 22, the finger sheath 34, and the movable arcing contact 30. When the finger sheath 34 is withdrawn, all current flows between the abutting contacts 30 and 32, separation of which establishes an arc. Valve action is provided by the movable nozzle structure 22 which initiates a blast of $SF_6$ from the high-pressure plenum 10 into the arcing chamber 11 when the nozzle mouth 24 separates from the nozzle mouth 18. The $SF_6$ gas flows radially inward between the nozzle mouths 18 and 24 and exhausts axially therethrough.

The sequence of movement and degree of movement of the aforesaid mechanisms is directly controlled by the contour of the channels 40, 42, 44 and 46. A different sequence of operation can be obtained merely by replacing the cam plate 36 with a plate having channels of a different contour.

Figure 4:
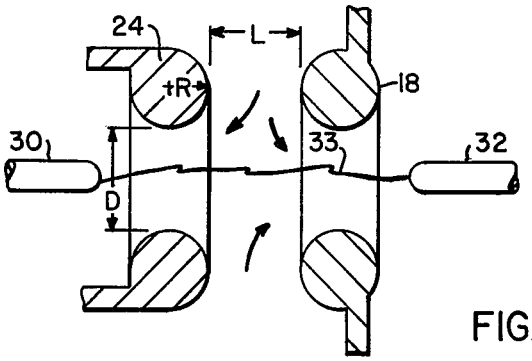
FIG. 4 is an enlarged view of the nozzle and contact structure of FIG. 2, shown in an open position.

In previous designs nozzles with a larger separation were needed in order to withstand BIL testing and to insure proper current-interrupting capabilities by providing for reasonably complete mixing of cool $SF_6$ with the arc column. The present invention maintains sufficient current-interrupting and BIL-withstand capability while providing a higher rate of rise of recovery voltage rating. This is accomplished by decreasing the separation L and increasing the radius R, dimensions shown in FIG. 4, which results in a smaller L/R ratio. The decreased separation L results in a smaller arcing chamber requiring a shorter time for $SF_6$ gas to clear the chamber of arcing products, while decreasing the L/R ratio results in a higher electric field utilization factor, both of which provide for increased rate of rise of recovery voltage capabilities. By increasing the radius R the electric field stress concentration is reduced, maintaining the BIL rating. In the present invention the ratio of nozzle diameter to nozzle separation (D/L) is 1.0 and the ratio of nozzle separation to nozzle radius (L/R) is 2.0. While the benefits cited above can be obtained with values of L/R from approximately 1.0 to 4.0, the 2.0 value is preferred. This configuration results in a 25 percent local increase in the mean electric field stress concentration near the nozzle as opposed to the 150 to 900 percent electric field stress concentration which resulted from previous designs. These factors are reflected directly in bus fault rate of rise of recovery voltage capability (i.e., increases in acceptable rate of rise of recovery voltage by at least a factor of 2), and to some extent for short line fault rate of rise of recovery voltage.

With the mechanism of the present invention the arc is initiated in the axial position yet can still be held in the short low-energy phase for any desired length of time, reducing the tendency for energy clogging to occur and maintaining current interruption capability. The arc is axial at all times and cannot transfer to the nozzle-valve since the electric field stress concentration is reduced in that region as compared with that at the electrodes. This forced axial position of the arc combined with the ability to vary its length at will allows the circuit breaker to provide optimum performance under a variety of service requirements.

Figure 5A:
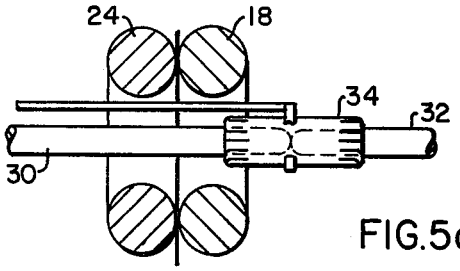
FIGS. 5*a*, 5*b*, 5*c*, and 5*d* are a series of schematic views showing one of several possible interrupting sequences.
Figure 5B:
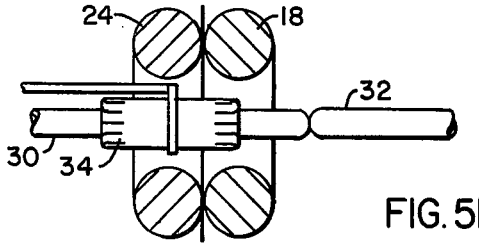
Figure 5C:
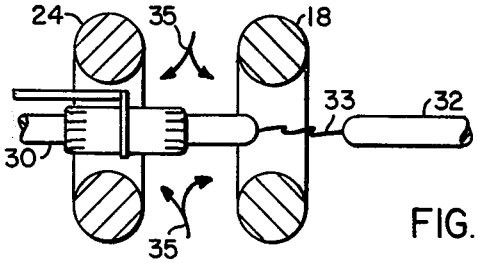
Figure 5D:
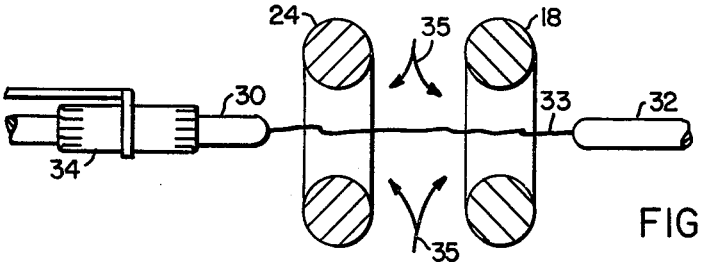

The FIGS. 5*a*, 5*b*, 5*c*, and 5*d* illustrate in a schematic fashion one interrupting sequence achievable with the present invention. In diagram of FIG. 5*a* the arcing contacts 30 and 32 are in abutment and the steady state contact finger sheath 34 is in engagement with both arcing contacts. The nozzle mouths 18 and 24 are also in abutment. In the FIG. 5*b* the steady-state contact finger sheath 34 has been withdrawn and current is transferred to the arcing electrodes 30 and 32. FIG. 5*c* shows the nozzles and arcing contacts separated simultaneously initiating an arc 33 and a blast of $SF_6$, indicated by arrows 35. The arc 33 is then held at a short length for a period of time until the pressure transient generated by the establishment of the arc has dissipated. The FIG. 5*d* shows the arcing contacts fully withdrawn to allow full flow of $SF_6$ gas through the nozzles.

Figure 6A:
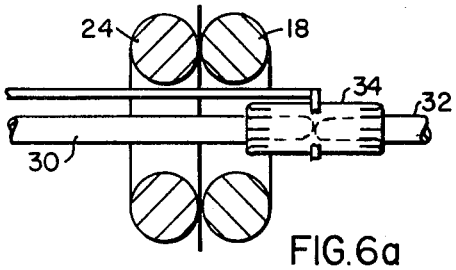
FIGS. 6*a*, 6*b*, 6*c*, 6*d*, and 6*e* are a series of schematic views showing another possible interrupting sequence.
Figure 6B:
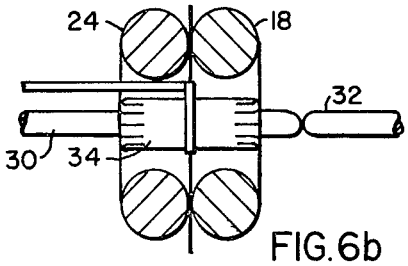
Figure 6C:
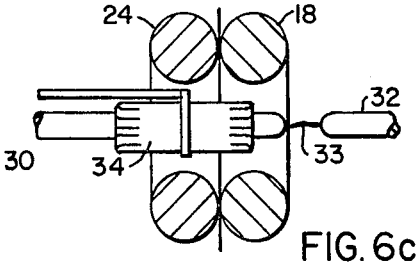
Figure 6D:
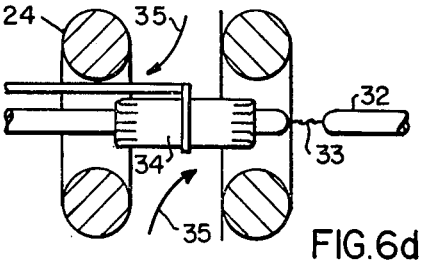
Figure 6E:
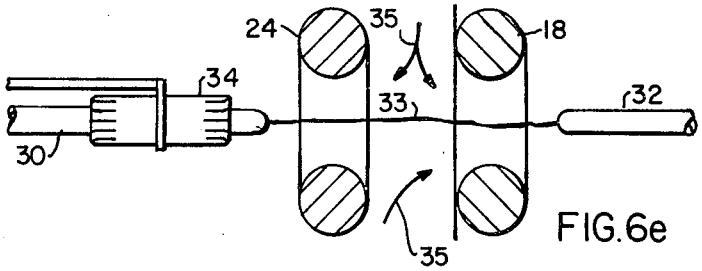

FIGS. 6*a*, 6*b*, 6*c*, 6*d*, and 6*e* illustrate another interrupting sequence achievable with the present invention merely by exchanging cam plate 36, shown in FIG. 2, for a cam plate with a different series of contoured channels 40, 42, 44, 46. The FIG. 6a again shows arcing contacts 30 and 32 in abutment, nozzle mouths 18 and 24 in a closed position, and steady-state contact finger sheath 34 engaging both arcing contacts. In the FIG. 6*b* the steady-state contact finger sheath has withdrawn and current has transferred to the arcing electrodes. The FIG. 6*c* shows the initial separation of arcing electrodes to establish a low-power arc 33 which is held to allow pressure fluctuations produced by the arc 33 to decay. The nozzle mouths remain in abutment. The FIG. 6*d* shows the nozzle mouths separated, initiating $SF_6$ gas flow represented by arrows 35 while the arc 33 remains in a short low energy condition. The arc is lengthened in the FIG. 6*e* to allow complete cooling of the central section of the arc by the established $SF_6$ flow.

Figure 7A:
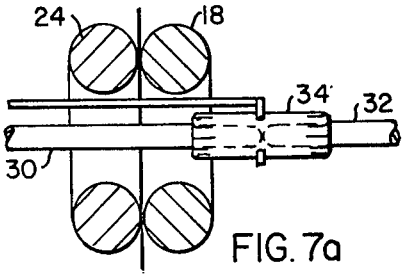
Figure 7B:
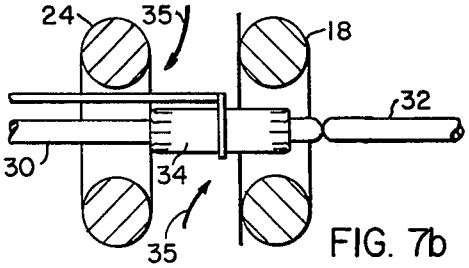
Figure 7C:
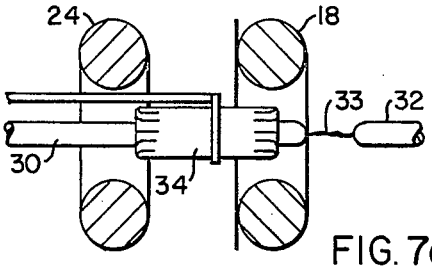
Figure 6D:
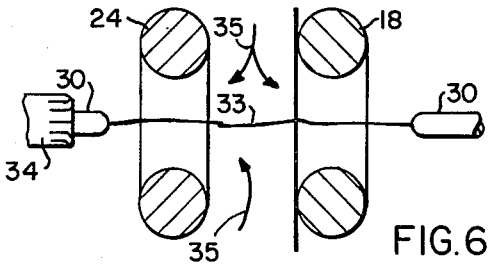

Yet another possible interrupting sequence achievable with the present invention is shown in FIGS. 7*a*, 7*b*, 7*c*, and 7*d*. Here the nozzle mouths 18 and 24 are separated prior to separation of the arcing contacts, allowing initiation of $SF_6$ flow, represented by arrows 35, prior to the establishment of an arc. Again the arc is briefly held in a short low energy configuration and later lengthened to complete the interrupting procedure as shown in FIG. 7*d*.

These and other interrupting sequences are all achievable with the present invention. Extensive modification is not necessary; installation of a rotatable cam plate 36 with channel contours 40, 42, 44, and 46 designed to produce the required sequence and degree of movement is all that is required. Such flexibility enables a single circuit breaker to meet a large variety of service requirements. In addition experimentation with a variety of interrupting sequences will expedite construction of the optimum circuit breaker for any set of service requirements.

From the foregoing description, it will be apparent that there has been provided an improved fluid blast circuit interrupter in which more compact construction is achieved with increased rate of rise of recovery voltage capability while maintaining current interrupting capability and BIL withstand testing ratings. The invention provides a circuit breaker with great flexibility to meet a variety of service requirements.

Although there has been illustrated and described a specific structure, it is to be understood that the same is merely for the purpose of illustration, and that changes and modifications may readily be made therein by those skilled in the art, without departing from the spirit and scope of the invention.

We claim:

1. A fluid-blast circuit interrupter comprising:

a. steady-state contacts for carrying current when said interrupter is in a closed circuit position, at least one of said steady-state contacts being movable relative to the other steady-state contacts, b. arc-establishing contacts, at least one of said arc-establishing contacts being movable relative to another arc-establishing contact for establishing an arc therebetween, c. fluid flow directing means, d. valve means for initiating a blast of arc-extinguishing fluid, said valve means and said moving arc-establishing contact being individually actuable, e. means for supplying high pressure arc-extinguishing fluid to said valve means, and f. common means for separately actuating said valve means, said steady state contacts, and said arc establishing contact in a variable and predetermined manner.

2. A fluid blast circuit interrupter as claimed in claim 1 wherein said fluid flow directing means comprises a double-flow nozzle structure.

3. A fluid blast circuit interrupter as claimed in claim 1 wherein said valve means comprises a pair of separable abutting nozzles and gasket means operable to seal out high-pressure arc-extinguishing fluid when said nozzles are in abutment.

4. A fluid blast circuit interrupter as claimed in claim 1 wherein said common means comprises a cam, said cam including a plurality of contoured surfaces; the contour of said surfaces determining the sequence of actuation and degree of movement of said movable arc-establishing contact, said movable steady-state contact, and said valve means.

5. A fluid blast circuit interrupter as claimed in claim 4 comprising a plurality of rigid extending members having first and second ends; said movable arc-establishing contact, said movable steady-state contact, and said valve means each being connected to separate first ends of said extending members, said second ends of each of said rigid members having a pin extending therefrom; said cam comprising a rotatable cam plate including a plurality of contoured channels, each of said channels engaging one of said pins; said interrupter also comprising means for rotating said cam plate to actuate said arc-establishing contacts, said steady-state contacts, and said valve means; the sequence of actuation and degree of movement of said movable arc-establishing contacts, said movable steady-state contact and said valve being determined by the contours of said channels.

6. A fluid blast circuit interrupter comprising:

a. means defining cooperating first and second nozzle members each having a convergent toroidal-shaped nozzle mouth, each of said nozzle mouths having a radius of curvature $R$, said nozzle mouths being separated by a distance $L$ and related by the following equation:

$$L = AR$$

where $A$ has any value from 1 to 4;

b. means for axially establishing an arc through both of said nozzle members; and c. means for producing a blast of arc-extinguishing fluid, said fluid flowing radially inward between said nozzle members and exhausting axially through said nozzle members away from said nozzle mouths to effect extinction of said established arc.

7. A fluid blast circuit interrupter as claimed in claim 6 wherein A has a value of 2.

8. A fluid blast circuit interrupter comprising:

a. means defining cooperating first and second nozzle members, at least of one said nozzle members being movable, each of said nozzle members having convergent toroidal-shaped nozzle mouths;

b. means for axially establishing an arc through both of said nozzle members; and c. means for producing a blast of arc-extinguishing fluid, said fluid flowing radially inward between said nozzle members and exhausting axially through said nozzle members away from said nozzle mouths to affect extinction of said established arc.

9. A fluid blast circuit interrupter as claimed in claim 8 wherein each of said nozzle mouths has a radius of curvature $R$, said nozzle mouths are separated by distance $L$, and the following equation holds:

$$L = AR$$

where $A$ has any value from 1 to 4.

10. A fluid blast circuit interrupter as claimed in claim 9 wherein A has a value of 2.

* * * * *